United States Patent [19]

Tanaka et al.

[11] 3,930,852

[45] Jan. 6, 1976

[54] ELECTROPHOTOGRAPHIC SENSITIVE MEMBER WITH ATTACHING MEANS

[75] Inventors: Susumu Tanaka, Sakai; Yuji Enoguchi, Higashi-Osaka; Hidetoshi Kawabata, Tondabayashi, all of Japan

[73] Assignee: Minolta Camera Kabushiki Kaisha, Osaka, Japan

[22] Filed: Apr. 8, 1974

[21] Appl. No.: 458,612

[30] Foreign Application Priority Data

Apr. 11, 1973 Japan ..... 48-41640

[52] U.S. Cl. ..... 96/1.5; 96/1.8

[51] Int. Cl.[2] ..... G03G 5/00

[58] Field of Search ..... 96/1.5, 1.8

[56] References Cited

UNITED STATES PATENTS

| | | | |
|---|---|---|---|
| 2,277,013 | 3/1942 | Carlson | 96/1.5 X |
| 3,190,199 | 6/1965 | Clark | 96/1.5 X |
| 3,536,481 | 10/1970 | Hespenheide et al. | 96/1.5 X |
| 3,552,957 | 1/1971 | Hodges | 96/1.5 |
| 3,574,615 | 4/1971 | Morse | 96/1.5 |
| 3,578,445 | 5/1971 | Elchisak | 96/1.5 |

*Primary Examiner*—David Klein
*Assistant Examiner*—John R. Miller
*Attorney, Agent, or Firm*—Wolder & Gross

[57] ABSTRACT

An electrophotographic sensitive member comprises of a flexible web having a photosensitive layer and provided with a longitudinally uni-directionally heat contractible insulating connector sheet of a predetermined length extending from one end thereof. In attaching the sensitive member over an endless support, the free end of the sensitive member is adhered to the free end of the connector sheet and the connector sheet is contracted to tightly embrace the member on the endless support upon the application of heat.

5 Claims, 4 Drawing Figures

ELECTROPHOTOGRAPHIC SENSITIVE MEMBER WITH ATTACHING MEANS

BACKGROUND OF THE INVENTION

The present invention relates generally to an improved electrophotographic sensitive member, and it relates more particularly to an improved electrophotographic sensitive member of the type including a coating of a photoconductive material on a flexible web substrate with attaching means at one end thereof for mounting the electrophotographic sensitive member to electrophotographic equipment, such as an endless support.

Conventionally, the photosensitive member plates employed in image transfer electrophotographic reproducing apparatus have been those formed with a layer such as Selenium, Selenium-tellurium alloy or Selenium-arsenic alloy directly over the surface of a metallic drum or endless belt by vacuum deposition, or those formed with a coating inorganic semi-conductive corpuscles of such as CdS, CdSe and ZnS-CdS over the surface of said drum or belt by the use of an organic resin binder, such as alkyd resin, epoxy resin, acryl resin or the like.

However, with these photosensitive member plates, it generally is necessary to deposit or to coat the photosensitive material onto the rotary drum or the endless belt individually and thus not only is the productivity awkward, poor and expensive, but the restoration and repair of damages caused to the photosensitive member are time consuming and difficult.

In overcoming these disadvantages of the conventional photosensitive plates and for improving the productivity thereof, the photosensitive member, formed with an electrical photosensitive layer over a durable and flexible sheet-like film composed of polyester film or the like or metal sheet, mounted over the peripheral surface of a drum or an endless belt has heretofore been provided. For this type of photosensitive member, a member coated with a charge transportable complex composition, for example, polyvinylcarbazole containing TNF (trinitrofluorenone) on a polyester film metalized with aluminum, or a member including such film vacuum deposited with a thin layer (less than 1 micron) of inorganic semiconductive corpuscles of Selenium or Selenium-tellurium alloy and coated thereover with polyvinylcarbazole not containing any sensitizer, or a member in which the polyester film is coated with ZnO or CdS over by the use of the aforesaid organic resin binder, or a member coated with CdS over a transparent polyester film with the use of said organic resin binder and further coated thereover with graphite carbon or the like acting as an electroconductive layer with the use of said organic resin binder are known in the art.

Various methods and means for mounting and attaching the aforesaid type of photosensitive members on a rotary drum are described in U.S. Pat. No. 3,341,681, in U.S. Pat. No. 3,552,957 and in U.S. Pat. No. 3,588,242. In the aforesaid patents there are described systems in which metal clamp portions provided at both ends of the photosensitive member are spot welded or riveted to a rotary drum, or in which there is provided an opening running parallel to the axial direction of the rotary drum and there is disposed a pair of winding means inside said drum, and the photosensitive member extends from said winding means over the peripheral surface of said drum.

However, with such methods for attaching the photosensitive member provided with or without attaching means, special tools or devices such as a welding or a riveting tool are required to attach the photosensitive member over a drum, and the structure rotary drum itself is highly complicated as it requires a longitudinal opening and sufficient interior space for the housing of the winding means thereby resulting in numerous drawbacks and disadvantages, including high costs and poor application efficiencies.

SUMMARY OF THE INVENTION

It is accordingly a principle object of the present invention to provide an improved means for attaching an electrophotographic sensitive member to an endless support.

It is another object of the present invention to provide an improved electrophotographic sensitive member having novel attaching means and requiring no particular tools or devices for the application thereof.

It is another object of this invention to provide a simplified method for attaching a photosensitive member to an advancing support.

It is still another object of this invention to provide an inexpensive method for attaching a photosensitive member to a support.

Pursuant to the present invention, the above and other objects are achieved by a novel attaching means provided at an end of an electrophotographic sensitive member. Such attaching means includes a uni-directionally contractible insulating member sheet provided at one end of the photosensitive member which consists of photosensitive layer coated over a sheet-like flexible substrate with which it is mounted over an endless support and thereafter the uni-directionally contractible insulating member sheet connected to the opposite ends of the photosensitive member is heated to contract it in one direction whereby the photosensitive member is attached rigidly over and tightly embraces the endless support.

For a fuller understanding of the nature and objects of the present invention, reference is made to the following detailed description taken in conjunction with the accompanying drawings.

DESCRIPTION OF THE PREFERRED EMBODIMENTS

Figure 1:
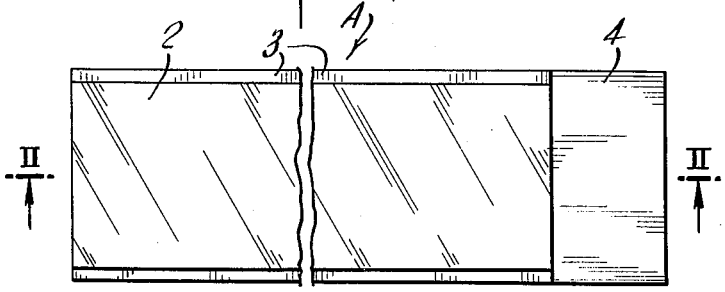
FIG. 1 is a plan view of an electrophotosensitive member embodying the present invention shown in a lay flat condition.
Figure 2:
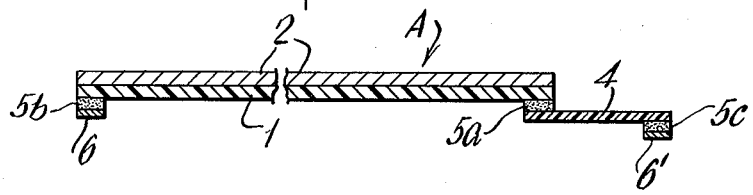
FIG. 2 is a sectional view taken along line 11—11 of FIG. 1.

Referring now to FIGS. 1 and 2, the reference letter A generally designates an electrophotographic sensitive member which is composed of a rectangular sheet or polyester film 1 or the metalized polyester film having an electroconductive coating or a layer such as of aluminum, copper or silver thereon with the photosensitive material layer 2 consisting of ZnO or CdS coated on the surface of the metalized polyester film 1 with the use of an organic resin binder. The side borders 3 of the polyester film are uncoated and serve to electrically connect the electrophotographic sensitive member A to the rotary drum 7 (FIG. 3) by means of, for example, an electrical tape in order to maintain the photosensitive layer 2 and the rotary drum at the same potential. Only non-coated borders 3 may be provided at either side portion of the polyester film 1. It should be noted that the aforesaid non-coated borders or portions 3 are not necessary if an electrically conductive members of metallic film such as of stainless steel or aluminum alloy is used as the substrate instead of the polyester film 1 since this electrically conductive member would contact directly with the rotary drum 7. Briefly, the electrophotographic sensitive member A, as descriibed above, comprises of the polyester film 1 with the surface thereof metalized, and the photosensitive layer thereon bordered at its sides by the non-coated portions 3.

At one end of the photosensitive member A, there is provided a uni-directionally contractible plastic sheet 4 made of polypropylene or other suitable materials as will be hereinafter described. Said uni-directionally contractible plastic sheet 4 is integrally adhered to the photosensitive member A at respective overlapping ends by an adhesive 5*a* with the contractible orientation of direction of the plastic sheet 4 longitudinal to coincide with the lengthwise or longitudinal direction of the photosensitive member A. In the drawings, the contractible direction or orientation of the plastic sheet 4 is to left and right as viewed in FIG. 1. Among the other suitable materials which may be used as the uni-directionally contractible plastic sheet 4, are polyethylene, polystyrene, polyvinyl chloride, polyvinylidene chloride, polyester film and 4-ethylene fluoride. These materials which may be used as the uni-directionally heat contractible insulating member 4 are made by stretching a sheet of such material during the manufacturing thereof to orient the molecules in one direction only, that is longitudinally in the direction of stretch as is well known in the art.

On the underface of the other lengthwise or free end of the photosensitive member A, that is, at the left end of the polyester film 1, there is provided a transverse band of an adhesive 5*b* which is advantageously a pressure sensitive adhesive and is covered by a separable strip 6 of release paper or sticker paper. Similarly, at the other or free end of the plastic sheet 4, at the underface thereof, a transverse band of an adhesive 5*c* is provided and releasably covered with the release paper 6′ thereon. The release papers 6, 6′ protect the adhesive agent coating the respective end borders of the photosensitive member A and the plastic connector sheet 4. The adhesive agent is advantageously made of a resin selected such as polyurethane resin, a nitrile rubber denaturant resin, or the like.

Figure 3:
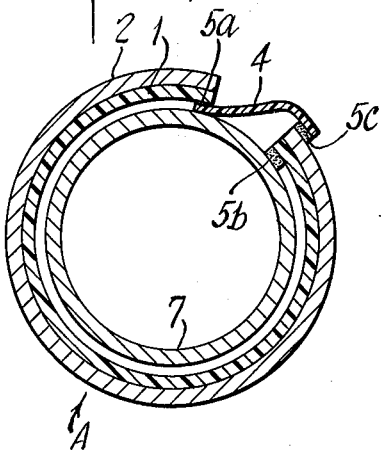
FIGS. 3 and 4 are sectional views showing successive steps in attaching the photosensitive member to a rotary drum.

In mounting and attaching the electrophotographic sensitive member A onto a rotary drum 7 or over a plurality of rollers so as to be in the form of endless belt, the release paper 6 protecting the adhesive 5*b* provided at the left end rear face of the photosensitive member A (FIG. 2) is removed and the photosensitive member A is applied to the rotary drum 7 with the end border of the photosensitive member A secured to the rotary drum 7 along the axial direction thereof by means of the adhesive coating band 5*b* which adheres to a corresponding portion of the outer surface of the rotary drum 7. The photosensitive member A is wrapped around the peripheral surface of the rotary drum 7. Thereafter, the other release paper 6′ protecting the adhesive coating 5*c* at right rear end of the uni-directionally contractible plastic connector sheet 4 is removed and the end thereof is adhered to the end border of the photosensitive member A as shown in FIG. 3, thereby linking the sheet-like photosensitive member in a form of endless loop over the rotary drum. Although the end of the plastic connector sheet 4 having the adhesive band 5*c* is adhered directly over the photosensitive layer 2 in the above described embodiment, it is preferrable that the photosensitive member A have a non-coated portion at its end where adhered with adhesive band 5*c* on the plastic connector sheet for better adhesiveness. Further, as shown in FIG. 3, the photosensitive member A is initially mounted on the rotary drum 7 loosely as the entire length of the photosensitive member A with the uni-directionally contractible plastic connector sheet 4 is somewhat longer than the peripheral length of the rotary drum 7.

Figure 4:
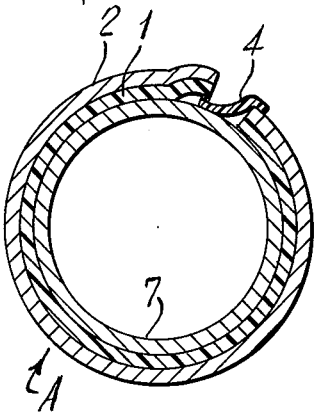

To firmly secure the photosensitive member A onto the rotary drum the uni-directionally contractible connector plastic sheet 4 is heated by means of a fan, circulating heated air, or other suitable heating means, not shown in the drawing. As the plastic sheet 4 is heated, it is contracted in the winding, or longitudinal or peripheral direction of the photosensitive member and accordingly the photosensitive member A tightly embraces and firmly engages the rotary drum 7, as shown in FIG. 4. Drawings of FIGS. 3 and 4 are exaggerated to show the respective elements in detail as the thickness of photosensitive member A and the plastic sheet 4 are of the order of microns.

In tests conducted by the applicants in connection with contraction characteristic of the uni-directionally contractible plastic sheet 4, it has been found that the uni-directionally contractible polypropylene film of 100 mm in length by 35 mm in width with a thickness of 80 microns is contracted to 55 mm in length by 33 mm in width by the application of warm air of 70° to 80° C at a velocity of 3–5 m/sec for about 30 seconds by means of a fan with a heating element. In other words, a contraction of 45 percent was attained in the contractible or molecular orientation direction while there was a contraction of less than 1 percent in the non-contractible or transverse direction. However, in the above tests, the resulting data were obtained with both sides of the sheet free to move in the non-contractible direction. Thus, in another experiment with the longitudinal sides of the sheet restrained, there was no contraction in the non-contractible direction, that is, the width of the connector sheet remained constant.

Accordingly, in practicing the present procedure, contraction in the non-contractible or transverse direction may be neglected as the both ends of the uni-directionally contractible plastic connector sheet 4 are adhered to the photosensitive member A and to the rotary drum 7. It should be noted that in the course of manufacturing, the contractibility of the uni-directionally contractible plastic sheet in the contractible direction is known beforehand for allowing the mounting of photosensitive member A on the rotary drum 7 with suitable strain.

As described above, the electrophotograhic sensitive member with the attaching means in accordance with the present invention relies on the use of a sheet-like flexible support or substrate with the photosensitive layer coated thereon as the photosensitive member, thus improving the productivity and costs. Further, the endless support over which the electrophotographic sensitive member is to be mounted requires no particular processing thereof and all that is needed is a compact heating means which could simply be a conventional hair dryer in attaching the photosensitive member. Thus all that is required in the manufacture of the photosensitive member would be to adhere the uni-directionally contractible plastic sheet at one end of the photosensitive member. This eliminates the use of welding or riveting devices, as was necessary in the conventional procedures in attaching the photosensitive member, thus simplifying and improving the application efficiency. Still further the detachment of photosensitive member from a support is quite simple, as it can be detached simply by cutting the uni-directionally contractible plastic sheet by means of any suitable cutting device.

While the present invention has been particularly shown and described with reference to a preferred embodiment thereof, it will be understood by those skilled in the art that changes in form and details may be made therein without departing from the spirit and scope of the invention. One such change may be to omit the use of adhesive agent 5*b* at the left rear end of the photosensitive member for the photosensitive member need not be fixed on the drum 7 due to the contraction of the uni-directionally contractible plastic sheet 4.

We claim:

1. An electrophotographic sensitive member comprising a longitudinally extending flexible first web including a substrate provided with an electrically conducting layer and a photoconductive layer superimposed on said electrically conducting layer, and a connecting member extending longitudinally from an end of said first web and including an electrically insulating molecularly longitudinally stretch oriented, flexible, polymeric resin second web which is unidirectionally longitudinally heat contractible.

2. The electrophotographic sensitive member of claim 1 wherein said first and second webs are of rectangular configuration and substantially co-extensive in width.

3. The electrophotographic sensitive member of claim 1 including means for joining the free ends of said webs to form an endless loop.

4. The electrophotographic sensitive member of claim 1 including layers of an adhesive agent located along the underfaces of the free outer end borders of said webs.

5. An electrophotographic sensitive member comprising a flexible first web including a substrate having an electrically conductive layer with a photoconductive layer thereon and a uni-directionally longitudinally heat contractible second web of a predetermined length extending longitudinally from an end of said first web and formed of an electrically insulating molecularly longitudinally stretch oriented polymeric resin.

* * * * *